US011664156B2

(12) United States Patent
Park et al.

(10) Patent No.: US 11,664,156 B2
(45) Date of Patent: May 30, 2023

(54) COIL COMPONENT

(71) Applicant: SAMSUNG ELECTRO-MECHANICS CO., LTD., Suwon-si (KR)

(72) Inventors: No Il Park, Suwon-si (KR); Seung Mo Lim, Suwon-si (KR); Byung Soo Kang, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 378 days.

(21) Appl. No.: 16/931,872

(22) Filed: Jul. 17, 2020

(65) Prior Publication Data

US 2021/0350980 A1 Nov. 11, 2021

(30) Foreign Application Priority Data

May 8, 2020 (KR) ..... 10-2020-0055431

(51) Int. Cl.
*H01F 27/32* (2006.01)
*H01F 27/29* (2006.01)
*H01F 27/24* (2006.01)

(52) U.S. Cl.
CPC ..... *H01F 27/324* (2013.01); *H01F 27/292* (2013.01); *H01F 27/24* (2013.01)

(58) Field of Classification Search
CPC ..... H01F 27/324; H01F 27/292; H01F 27/24
See application file for complete search history.

(56) References Cited

U.S. PATENT DOCUMENTS 6,452,473 B1 * 9/2002 Suzuki ..... H01F 17/0013 336/200
2012/0169434 A1 * 7/2012 Masuda ..... H03H 7/1708 333/175
2014/0218150 A1 8/2014 Cho et al.
(Continued)

FOREIGN PATENT DOCUMENTS

JP 2000-353620 A 12/2000
JP 2000353620 A * 12/2000
(Continued)

OTHER PUBLICATIONS

Korean Office Action dated Aug. 2, 2021 issued in Korean Patent Application No. 10-2020-0055431 (with English translation).

*Primary Examiner* — Mang Tin Bik Lian
*Assistant Examiner* — Malcolm Barnes
(74) *Attorney, Agent, or Firm* — Morgan, Lewis & Bockius LLP

(57) ABSTRACT

A coil component includes a support substrate, a coil portion disposed on at least one surface of the support substrate, a body, in which the support substrate and the coil portion are disposed, having one surface and the other surface opposing each other, a first external electrode and a second external electrode disposed on the other surface of the body to be spaced apart from each other and connected to the coil portion, a marking portion disposed on the one surface of the body, and a first insulating layer disposed on the one surface of the body and having an opening exposing the marking portion. The marking portion has a thickness less than or equal to a thickness of the first insulating layer.

17 Claims, 7 Drawing Sheets

(56) References Cited

U.S. PATENT DOCUMENTS

| | | | | |
|---|---|---|---|---|
| 2015/0048915 | A1* | 2/2015 | Yoon | H01F 17/0013 336/192 |
| 2015/0380151 | A1* | 12/2015 | Choi | H01F 41/041 336/200 |
| 2016/0189863 | A1* | 6/2016 | Park | H01F 17/04 29/602.1 |
| 2016/0268038 | A1* | 9/2016 | Choi | H01F 27/255 |
| 2016/0276089 | A1* | 9/2016 | Inoue | H01F 17/0013 |
| 2017/0018351 | A1* | 1/2017 | Yatabe | H01F 27/2804 |
| 2017/0110240 | A1* | 4/2017 | Masuda | H01F 27/292 |
| 2017/0256353 | A1* | 9/2017 | Park | C23C 18/1653 |
| 2018/0061551 | A1* | 3/2018 | Kondou | H01F 27/2804 |
| 2018/0166211 | A1* | 6/2018 | Takatsuji | H02M 1/143 |
| 2018/0308609 | A1* | 10/2018 | Shinohara | H01F 17/0013 |
| 2018/0315545 | A1* | 11/2018 | Kusumoto | H01G 4/38 |
| 2018/0358169 | A1 | 12/2018 | Nishikawa et al. | |
| 2019/0189338 | A1* | 6/2019 | Kim | H01F 27/2828 |
| 2019/0199310 | A1* | 6/2019 | Sato | H01F 41/043 |
| 2020/0020477 | A1 | 1/2020 | Kang et al. | |
| 2020/0082990 | A1* | 3/2020 | Yamamoto | H01F 27/363 |
| 2020/0328023 | A1 | 10/2020 | Kim | |

FOREIGN PATENT DOCUMENTS

| | | | |
|---|---|---|---|
| JP | 2007-242806 | A | 9/2007 |
| JP | 2018-037516 | A | 3/2018 |
| JP | 2018-207028 | A | 12/2018 |
| KR | 20-0271730 | Y1 | 3/2002 |
| KR | 10-2014-0100378 | A | 8/2014 |
| KR | 10-2016-0108935 | A | 9/2016 |
| KR | 10-2020-0006450 | A | 1/2020 |
| KR | 10-2020-0120375 | A | 10/2020 |

* cited by examiner

COIL COMPONENT

CROSS-REFERENCE TO RELATED APPLICATION(S)

This application claims the benefit under 35 USC 119 (a) of Korean Patent Application No 10-2020-0055431 filed on May 8, 2020 in the Korean Intellectual Property Office, the entire disclosure of which is incorporated herein by reference for all purposes.

TECHNICAL FIELD

The present disclosure relates to a coil component.

BACKGROUND

An inductor, a coil component, is a typical passive electronic component used in electronic devices, along with a resistor and a capacitor.

As electronic devices tend to have higher performance and to be smaller, coil components used in electronic devices may be increased in number and decreased in size. Accordingly, there have been continuous developments in a thin-film inductor in which a coil portion is formed on a substrate by plating, a coil formed on the substrate is embedded with a magnetic material sheet, and an external electrode is formed on an external surface of a magnetic body.

To identify a direction, in which a coil component is mounted on amounting board, or the like, a marking portion may be formed on an upper surface of a body. When a marking portion is formed using a screen-printing method according to the related art, the marking portion has a shape protruding from a surface of the body. As a result, a size of the entire component is increased by the thickness of the protruding marking portion.

Accordingly, there is an increasing need to manufacture a coil component in which a marking portion does not protrude from the entire component to achieve lightness, thinness, shortness, and smallness of the component.

In addition, when an insulating layer is formed on a surface of a body of the related art using a spray method or the like, the insulating layer may extend to a marking portion region of an upper surface of the body to cover a marking portion.

Accordingly, there is a need to selectively form an insulating layer only on the surfaces of a body on which a marking portion is not formed.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

An aspect of the present disclosure is to provide a coil component in which a marking portion does not protrude from the entire component to achieve lightness, thinness, shortness, and smallness of the component.

Another aspect of the present disclosure is to provide a coil component in which an insulating layer is selectively formed only on the surfaces of a body on which a marking portion is not formed.

According to an aspect of the present disclosure, a coil component includes a support substrate, a coil portion disposed on at least one surface of the support substrate, a body, in which the support substrate and the coil portion are disposed, having one surface and the other surface opposing each other, a first external electrode and a second external electrode disposed on the other surface of the body to be spaced apart from each other and connected to the coil portion, a marking portion disposed on the one surface of the body, and a first insulating layer disposed on the one surface of the body and having an opening exposing the marking portion. The marking portion has a thickness less than or equal to a thickness of the first insulating layer.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
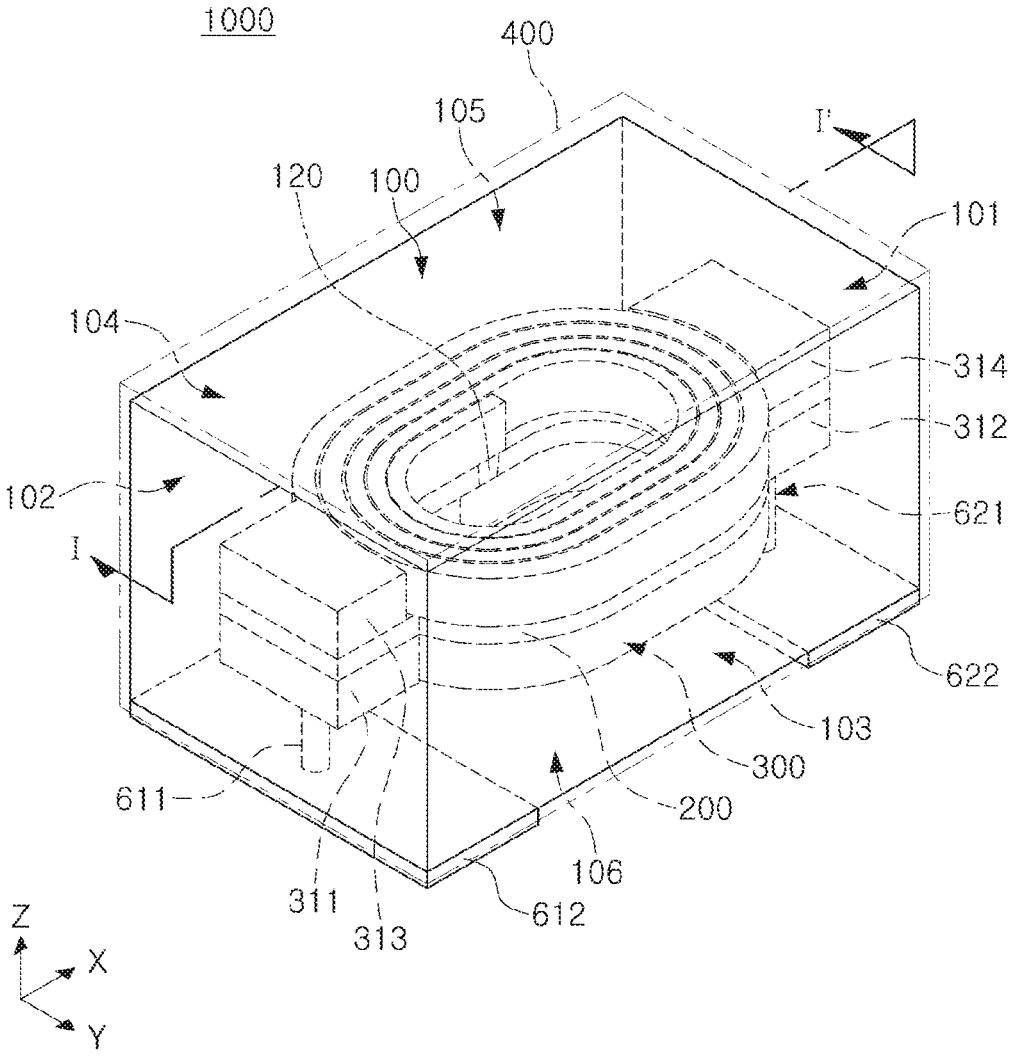
FIG. 1 is a schematic diagram of a coil component according to a first embodiment of the present disclosure.

The following detailed description is provided to assist the reader in gaining a comprehensive understanding of the methods, apparatuses, and/or systems described herein However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after gaining an understanding of the disclosure of this application. Further, although the examples described herein have a variety of configurations, other configurations are possible as will be apparent after gaining an understanding of the disclosure of this application.

The drawings may not be to scale, and the relative size, proportions, and depiction of elements in the drawings may be exaggerated for clarity, illustration, and convenience.

A value used to describe a parameter such as a 1-D dimension of an element including, but not limited to, "length," "width," "thickness," "diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used.

In the drawings, the X direction may be defined as a first direction or a longitudinal direction, a Y direction as a second direction or a width direction, and a Z direction as a third direction or a thickness direction.

Hereinafter, a coil component according to an exemplary embodiment will be described in detail with reference to the accompanying drawings, and in describing with reference to the accompanying drawings, the same or corresponding components are assigned the same reference numbers, and overlapped descriptions thereof will be omitted.

Various types of electronic components are used in electronic devices, and various types of coil components may be appropriately used to remove noise between the electronic components.

For example, in electronic devices, coil components may be used as power inductors, high-frequency (HF) inductors, general beads, high-frequency beads (GHz Beads), and common mode filters.

First Embodiment

Figure 2:
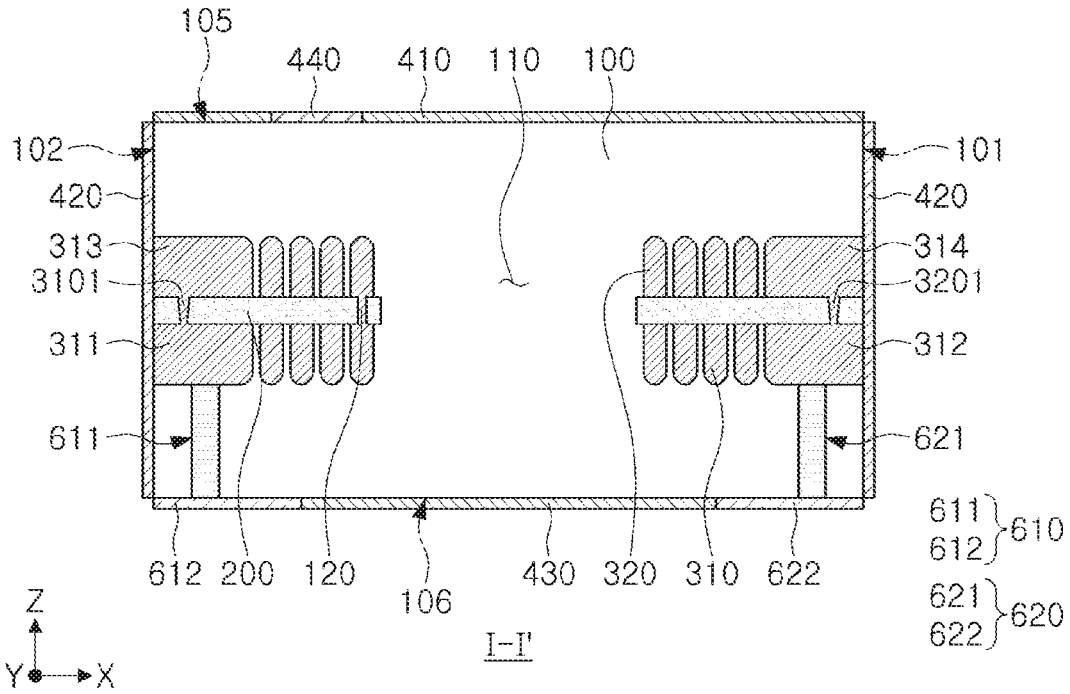
FIG. 2 is a cross-sectional view taken along line I-I' of FIG. 1.

FIG. 1 is a schematic diagram of a coil component according to a first embodiment, and FIG. 2 is a cross-sectional view taken along line I-I' of FIG. 1.

Referring to FIGS. 1 and 2, a coil component 1000 according to a first embodiment may include a body 100, a support substrate 200, a coil portion 300, external electrodes 610 and 620, a marking portion 440, a first insulating layer 410, a coating layer 450, a second insulating layer 420, and a third insulating layer 430.

The support substrate 200 is disposed in the body 100 to be described later and supports the coil portion 300.

The support substrate 200 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the support substrate 200 may be formed of an insulating material such as prepreg, Ajinomoto Build-up Film (ABF), FR-4, a bismaleimide triazine (BT) film, a photoimageable dielectric (PID) film, and the like, but the present disclosure is not limited thereto.

The inorganic filler may be at least one or more selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$).

When the support substrate 200 is formed of an insulating material including a reinforcing material, the support substrate 200 may provide better rigidity. When the support substrate 200 is formed of an insulating material not including glass fibers, the support substrate 200 may be advantageous for thinning the overall coil portions 310 and 320.

A through-hole, not illustrated, is formed through a central portion of the support substrate 200, and the through-hole, not illustrated, may be filled with a magnetic material of the body 100 to be described later to form a core portion 110. As described above, the core portion 110 filled with the magnetic material may be formed to improve performance of an inductor.

The body 100 may form an exterior of the coil component 1000 according to this embodiment, and may embed the coil portion 300 therein.

The body 100 may be formed to have a hexahedral shape overall.

Based on FIG. 1, the body 100 may have a first surface 101 and a second surface 102 opposing each other in a length direction X, a third surface 103 and a fourth surface 104 opposing each other in a width direction Y, and a fifth surface 105 and a sixth surface 106 opposing each other in a thickness direction Z. In this embodiment, the fifth surface 105 and the sixth surface 106 of the body 100 may correspond to one surface and the other surface, respectively. The first to fourth surfaces 101, 102, 103, and 104 of the body 100 may correspond to a plurality of side surfaces of the body 100 connecting the fifth surface 105 and the sixth surface 106 of the body 100 to each other.

The body 100 may be formed such that the coil component 1000 according to this embodiment, in which the external electrodes 610 and 620 to be described later are formed, has a length of 2.0 mm, a width of 1.2 mm, and a thickness of 0.65, or a length of 1.6 mm, a width of 0.8 mm, and a thickness of 0.5 mm, but the present disclosure is not limited thereto.

The body 100 may include a magnetic material and a resin. Specifically, the body 100 may be formed by laminating at least one magnetic composite sheet including the resin and the magnetic material dispersed in the resin. The body 100 may have a structure other than the structure in which the magnetic material may be dispersed in the resin. For example, the body 100 may be formed of a magnetic material such as ferrite.

The magnetic material may be, for example, a ferrite powder particle or a magnetic metal powder particle.

Examples of the ferrite powder particle may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The magnetic metal powder particle may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic material may be amorphous or crystalline. For example, the magnetic metal powder particle may be a Fe—Si—B—Cr-based amorphous alloy powder, but the present disclosure is not limited thereto.

Each of the ferrite powder and the magnetic metal powder particle may have an average diameter of about 0.1 μm to 30 μm, but the present disclosure is not limited thereto.

The body 100 may include two or more types of magnetic materials dispersed in a resin. In this case, the term "different types of magnetic material" means that the magnetic materials dispersed in the resin are distinguished from each other by average diameter, composition, crystallinity, and a shape.

The resin may include an epoxy, a polyimide, a liquid crystal polymer, or the like, in a single form or in combined forms, but the preset disclosure is not limited thereto.

The body 100 may include the core portion 100 penetrating through the coil portion 300 to be described later. The core portion 110 may be formed by filling a through-hole with the magnetic composite sheet, but the present disclosure is not limited thereto.

The coil portion 300 may be disposed in the body 100 to express characteristics of the coil component. For example, when the coil component 1000 of this embodiment is used as a power inductor, the coil portions 300 may function to stabilize a power supply of an electronic device by storing an electric field as a magnetic field and maintaining an output voltage.

The coil portion 300 applied to this embodiment may include first and second coil patterns 310 and 320 and first and second lead-out patterns 311 and 312.

The coil portion 300 may be disposed on one surface and the other surface of the support substrate 200 opposing each other.

Referring to FIG. 2, the coil portion 300 may include a first coil pattern 310, disposed on one surface of the support substrate 200, and a second coil pattern 320 disposed on the other surface of the support substrate 200 to be spaced apart from the first coil pattern 310.

The coil portion 300 may include a first lead-output pattern 311, disposed one surface of the support substrate 200 to be connected to the first coil pattern 310, and a second lead-out pattern 312 spaced apart from the first lead-out pattern 311 to be connected to the first coil pattern 310. In addition, the coil portion 300 may include a third lead-out pattern 313, disposed on the other surface of the support substrate 200 to be connected to the second coil pattern 320, and a fourth lead-out pattern 314 spaced apart from the third lead-out pattern 313 to be connected to the second coil pattern 320.

The first and second coil patterns 310 and 320 may be electrically connected to each other through a via electrode 120 penetrating through the support substrate 200. Each of the first coil pattern 310 and the second coil pattern 320 may have a planar spiral shape in which at least one turn is formed around the core portion 110. For example, the first coil pattern 310 may form at least one turn about an axis of the core portion 110 on the one surface of the support substrate 200.

In this embodiment, the coil portion 300 may include the third lead-out pattern 313 connected to the first lead-out pattern 311 through a first connection via 3101. In addition, the coil portion 300 may include the fourth lead-out pattern 314 connected to the second lead-out pattern 312 through a second lead-out pattern 312 through a second connection via 3201.

Referring to FIG. 2, the first and third coil patterns 311 and 313 and the second and fourth lead-out patterns 312 and 314 may be disposed to correspond to each other around the support substrate 200. Specifically, the first lead-out pattern 311 disposed on one surface of the supporting substrate 200 may be disposed to correspond to the third lead-out pattern 313 disposed on the other surface of the supporting substrate 200. The second lead-out pattern 312 disposed on one surface of the supporting substrate 200 may be disposed to correspond to the fourth lead-out pattern 314 disposed on the other surface of the supporting substrate 200.

Referring to FIG. 2, the coil portion 300 and the first and second external electrodes 610 and 620 to be described later may be connected to each other through the first to fourth lead-out patterns 311, 312, 313, and 314. The first to fourth lead-out patterns 311, 312, 313, and 314 may be electrically connected to the first and second connection vias 3101 and 3201 to function as an input terminal or an output terminal of the coil component 100.

At least one of the coil portion 300 and the via electrode 120 may include at least one conductive layer.

For example, when the first coil pattern 310, the first lead-out pattern 311, and the via electrode 120 are formed on the one surface of the support substrate 200 by a plating process, each of the first coil pattern 310, the first lead-out pattern 311, and the via electrode 120 may include a seed layer, such as an electroless plating layer or the like, and an electroplating layer. In this case, the electroplating layer may have a single-layer structure or a multilayer structure The electroplating layer having a multilayer structure may be formed as a conformal film structure in which one electroplating layer may be covered with the other electroplating layer, and may be only formed in a structure in which the other electroplating layer is laminated on one surface of any one electroplating layer. The seed layer of the first coil pattern 310, the seed layer of the first lead-out pattern 311, the seed layer of the via electrode 120 may be integrally formed such that a boundary therebetween is not formed, but the present disclosure is not limited thereto. The electroplating layer of the first coil pattern 310, the electroplating layer of the first lead-out pattern 311, and the electroplating layer of the via electrode 120 may be integrally formed such that a boundary therebetween is not formed, but the present disclosure is not limited thereto.

Each of the coil portion 300 and the via electrode 120 may be formed of a conductive material such as copper (Cu), aluminum (Al), silver (Ag), tin (Sn), gold (Au), nickel (Ni), lead (Pb), titanium (Ti), or alloys thereof, but the present disclosure is not limited thereto.

The insulating layer 400 applied to this embodiment may include a first insulating layer 410, a second insulating layer 420, a third insulating layer 430, and a marking portion 440.

Referring to FIG. 2, the marking portion 440 may be disposed on the fourth surface 105 of the body 100.

The first insulating layer 410 is disposed on the fifth surface 105 of the body 100, and an opening is formed to expose the marking portion 440. As will be described later, the marking unit 440 may be formed by simultaneously or sequentially printing the marking portion 440 and the first insulating layer on the fifth surface 105 of the body 100 in a coil bar state. In such a printing process, an opening may be formed in a region of the first insulating layer 410 in which the marking portion 440 is to be formed, and the marking portion 440 may be formed in the opening of the first insulating layer 410.

In this embodiment, a thickness of the marking portion 440 is less than or equal to a thickness of the first insulating layer 410. Specifically, the thickness of the marking portion 440 may be 10 μm or less. Referring to FIG. 2, the thickness of the marking unit 440 corresponds to the thickness of the first insulating layer 410. The above-described opening may have a thickness be less than or equal to the thickness of the first insulating layer 410, or may be formed to have a thickness correspond to the thickness of the first insulating layer 410. As a result, the thickness of the marking portion 440 is substantially the same as the thickness of the above-described opening.

A method of measuring the thickness of the marking portion 440 and the thickness of the first insulating layer 410 may be a method of measuring a cut surface (e.g., a cut surface to obtain a cross-section in an X-Z plane shown in FIG. 2) of the body 100 using a micro-microscope, an optical microscope, a scanning electron microscope (SEM), or the like. In this case, a thickness of the body 100, in which the marking portion 440 and the first insulating layer 410 are not formed, may be measured first. Then, the thickness of the above-mentioned marking portion 440 may be compared with a total thickness of the marking portion 440, the first insulating layer 410, and the body 100 to measure the thickness of the marking portion 440 and the thickness of the first insulating layer 410.

In one example, the thickness of the marking portion 440 may means a dimension of the marking portion 440 in the thickness direction Z, and may be one of an average thickness, a maximum thickness, and a thickness measured in a center portion of the marking portion 440 in a cross-section. Similarly, the thickness of the first insulating layer 410 may means a dimension of the first insulating layer 410 in the thickness direction Z, and may be one of an average thickness, a maximum thickness, and a thickness measured in a center portion of the first insulating layer 410 in a cross-section.

In one example, the thickness of the marking portion 440 may be determined by defining a predetermined number (e.g., 5) of points to the left and the predetermined number (e.g., 5) of points to the right from a reference center point of the marking portion 440 at equal intervals (or non-equal intervals, alternatively), measuring a thickness of each of the points at equal intervals (or non-equal intervals, alternatively), and obtaining an average value therefrom, based on an image of a cross-section cut in an X-Z plane, scanned by, for example, a scanning electron microscope (SEM). The reference center point may have the same distance, or substantially the same distance in consideration of a measurement error, from opposing edges of the marking portion 440 in the cross-section cut. In this case, the thickness of the marking portion 440 may be an average thickness. The thickness of the first insulating layer 410 may be defined similar to the thickness of the marking portion 440.

Alternatively, the thickness of the marking portion 440 may be determined by defining a predetermined number (e.g., 5) of points to the left and the predetermined number (e.g., 5) of points to the right from a reference center point of the marking portion 440 at equal intervals (or non-equal intervals, alternatively), measuring a thickness of each of the points at equal intervals (or non-equal intervals, alternatively), and obtaining a maximum value therefrom, based on an image of a cross-section cut in an X-Z plane, scanned by, for example, a scanning electron microscope (SEM). In this case, the thickness of the marking portion 440 may be a maximum thickness. The thickness of the first insulating layer 410 may be defined similar to the thickness of the marking portion 440.

In a certain case, a marking part 440 may be formed on an upper surface of the body 100 identify a direction in which the coil component is mounted on amounting board. When a coil component is manufactured using a common screen printing method or the like, the marking portion 440 may have a shape protruding from an entire component. Accordingly, a size of the entire component may be increases by a thickness of a protruding portion of the marking portion 440. In this embodiment, the first insulating layer 410 and the marking portion 440 are formed on the fifth surface 105 of the body 100 using an inkjet printing method. Specifically, in a coil bar state, the first insulating layer 410 and the marking portion 440 may be simultaneously printed on the fifth surface 105 of the body 100, or may be divided into regions and the regions may be sequentially printed on the fifth surface 105 of the body 100. Such inkjet printing may prevent the marking portion 440 from protruding from the entire component. In addition, the above-described simultaneous printing or sequential printing may allow positional accuracy of the marking portion 440 to be more improved than in a printing method according to the related art. In one example, the marking portion 440 may include an insulating material or be made of an insulating material.

The marking portion 440 and the first insulating layer 410 have different colors. For example, the marking part 440 and the first insulating layer 410 may have different colors to be distinguished from each other on the fifth surface 105 of the body 100. In this embodiment, a difference in contrast between the marking portion 440 and the first insulating layer 410 may be identified using a high-resolution camera to recognize a difference in colors therebetween. For example, the color of the marking portion 440 may be white-based, and the color of the first insulating layer 410 may be black-based. The colors thereof are not necessarily limited as long as the marking portion 440 and the first insulating layer 410 may be distinguished from each other. As a result, the marking portion 440 may be formed to have various colors and shapes.

The second insulating layer 420 may be formed on the first to fourth surfaces 101, 102, 103, and 104 of the body 100.

The second insulating layer 420 is formed after the first insulating layer 410 and the marking portion 440 are formed in a coil bar state and individual chip dicing is then performed. The second insulating layer 420 may be formed using a spray coating method, a dipping method, or the like. The method of forming the second insulating layer 420 is not necessarily limited as long as it can form an insulating material. The second insulating layer 420 may include a polymer-based insulating material such as epoxy, a filler, and the like, and may have a thickness of 10 μm or more and 20 μm or less. A method of measuring the thickness of the second insulating layer 420 may a method of measuring a cut surface (e.g., a cut surface to obtain a cross-section in an X-Z plane shown in FIG. 2) of the body 100 using a micro-microscope, an optical microscope, a scanning electron microscope (SEM), or the like. In this case, a thickness of the body 100, in which the second insulating layer 420 is not formed, may be measured first. Then, a thickness of the second insulating layer 420 may be measured by comparing the thickness of the above-mentioned body 100 with a total thickness of the second insulating layer 420 and the body 100. In one example, the measurement of the thickness of the second insulating layer 420 may be performed in a manner similar to the measurement of the thickness of the marking portion 440, although a reference direction in the measurement of the thickness of the second insulating layer 420 is the length direction X.

The third insulating layer 430 is formed in a region of the sixth surface 106 of the body 100, other than a regions in which the first and second external electrodes 610 and 620 to be described later are disposed on the sixth surface 106 of the body 100.

The third insulating layer 430 is distinguished from the above-described first and second insulating layers 410 and 420, and is formed to be in contact with the sixth surface 106 of the body 100. When the third insulating layer 430 is formed on the sixth surface 106 of the body 100, first and second extension portions 612 and 622 of the first and second external electrodes 610 and 620 may extend upwardly of a lower surface of the third insulating layer 430 from the first and second connecting portions 611 and 621. The third insulating layer 430 may include a thermoplastic resin such as a polystyrene type resin, a vinyl acetate type resin, a polyester type resin, a polyethylene type resin, a polypropylene type resin, a polyamide type resin, a rubber type resin or an acrylic type resin, a thermosetting resin such as a phenol type resin, an epoxy type resin, a urethane type resin, a melamine type resin or an alkyd type resin, a photoimageable resin, parylene, or the like. The third insulating layer 430 may be formed by laminating an insulating film on the surface of the body 100, by depositing an insulating material on the surface of the body 100 using a thin film process, or by applying an insulating resin to the surface of the body 100 using a screen printing method.

The first and second external electrodes 610 and 620 are connected to the first lead-out pattern 311 and the second lead-out pattern 312, respectively. Referring to FIG. 2, each of the first and second external electrodes 610 and 620 includes first and second connection portions 611 and 621, connected to the first and second lead-out patterns 311 and 312, and first and second extension portions 612 and 622 extending to the first and second connection portions 611 and 621 and disposed on the sixth surface 106 of the body 100. The first and second external electrodes 610 and 620 may be spaced apart from each other. The first external electrode 610 and the second external electrode 620 may be electrically connected by the coil portion 300, but are spaced apart from each other on the surface of the body 100.

Specifically, the first external electrode 610 may include the first connection portion 611 disposed in a region, in which the first extraction pattern 311 is exposed, to be in contact with and connected to the first lead-out pattern 311 and the first extension portion 612 extending from the first connection portion 611 to the sixth surface 106 of the body 100. The second external electrode 620 may include the second connection portion 621 disposed in a region, in which the second lead-out pattern 312 is exposed, to be in contact with and connected to the second lead-out pattern 312 and the second extension portion 622 extending from the second connection portion 621 to the sixth surface 106 of the body 100.

Each of the first and second external electrodes 610 and 620 may be formed of a conductive material such as copper (Cu), aluminum (Al), silver (Ag), tin (Sn), gold (Au), nickel (Ni), lead (Pb), chromium (Cr), titanium (Ti), or alloys thereof, but the present disclosure is not limited thereto. Although not illustrated in detail, the first and second external electrodes 610 and 620 may be formed to have a single-layer structure or a multilayer structure. For example, the first external electrode 610 includes a first layer, not illustrated, including copper (Cu), a second layer, not illustrated, disposed on the first layer and including nickel (Ni), and a third layer, not illustrated, disposed on the second layer and including tin (Sn).

First Modified Embodiment of First Embodiment

Figure 3:
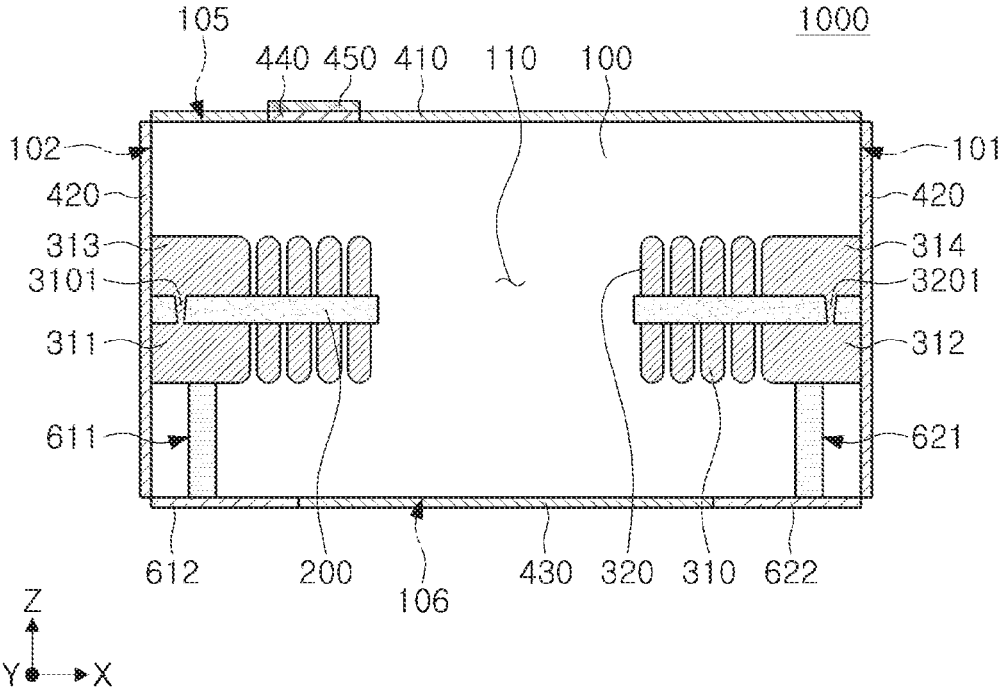
FIG. 3 is a view illustrating a coil component according to a first modified embodiment of the first embodiment of the present disclosure and corresponding to the cross-sectional view taken along line I-I' of FIG. 1.

FIG. 3 is a view illustrating a coil component according to a first modified embodiment of the first embodiment of the present disclosure and corresponding to the cross-sectional view taken along line I-I' of FIG. 1

A coil component 1000 according to this modified embodiment further includes a coating layer 450, as compared with the coil component 1000 according to the first embodiment. Therefore, the description of this modification will focus on only the coating layer 450, a difference from the first embodiment. Descriptions of the other configurations of this embodiment may be substituted with those of the first embodiment as it is.

Referring to FIG. 3, the coating layer 450 may be disposed on the marking portion 440.

When the second insulating layer 420 is formed on a plurality of side surfaces of a body 100 using a spray method according to the related art, the second insulating layer 420 may extend to an upper portion of the body 100 to cover the marking portion 440. In this embodiment, the coating layer 450 may be additionally provided on the marking portion 440 to selectively form the second insulating layer 420 on a portion of the fifth surface of the body 105, in which the marking portion 440 is not formed, and the first to fourth surfaces 101, 102, 103, and 104 of the body. On the other hand, as illustrated in FIG. 3, when the coating layer 450 is formed to correspond to a region in which the marking portion 440 is formed, an area occupied by the coating layer 450 in the component may be significantly reduced, and thus, a size of the entire component may be reduced.

In this embodiment, colors of the marking portion 440 and the coating layer 450 are different from each other. In addition, a thickness of the coating layer 450 is less than a thickness of the marking portion 440. A method of measuring the thickness of the coating layer 450 may be a method of measuring a cut surface (e.g., a cut surface to obtain a cross-section in an X-Z plane shown in FIG. 3) of the body 100 using a micro-microscope, an optical microscope, a scanning electron microscope (SEM), or the like. In this case, a thickness of the body 100, in which the first insulating layer 410, the marking portion 440, and the coating layer 450 are not formed, is measured first. Then, the thickness of the above-mentioned body 100, in which the first insulating layer 410, the marking portion 440, and the coating layer 450 are not formed, may be compared with a total thickness of the first insulating layer 410, the marking portion 440, the coating layer 450, and the body 100. In this case, the thickness of the coating layer 450 may be measured by excluding the thicknesses of the above-mentioned first insulating layer 410 and the above-mentioned marking portion 440. In one example, the measurement of the thickness of the coating layer 450 may be performed in a manner similar to the measurement of the thickness of the marking portion 440.

The coating layer 450 may include an inorganic filler. Alternatively, the coating layer may not include a raw material having a black color, and thus, may have a transparent color. The coating layer 450 may have a thickness of 2 μm or less and, in detail, 1 μm or less. Since the coating layer 450 has a transparent color and the thickness of the coating layer 450 is significantly less than the thickness of the marking portion 440, the identification function of the marking portion 440 may be secured even when the coating layer 450 is disposed on the marking portion 440

The coating layer 450 includes a polymer-based organic material. As described above, the coating layer 450 may include an inorganic filler or may not include a raw material having a black color. The coating layer 450 may be formed by a thin film vapor deposition method such as molecular vapor deposition (MVD), chemical vapor deposition (CVD), atomic layer deposition (ALD), or sputtering. However, the present disclosure is not limited thereto, and the coating layer 450 may be formed by a thick film method such as a spray method, a dipping method, screen printing, or the like.

Second Modified Embodiment of First Embodiment

Figure 4:
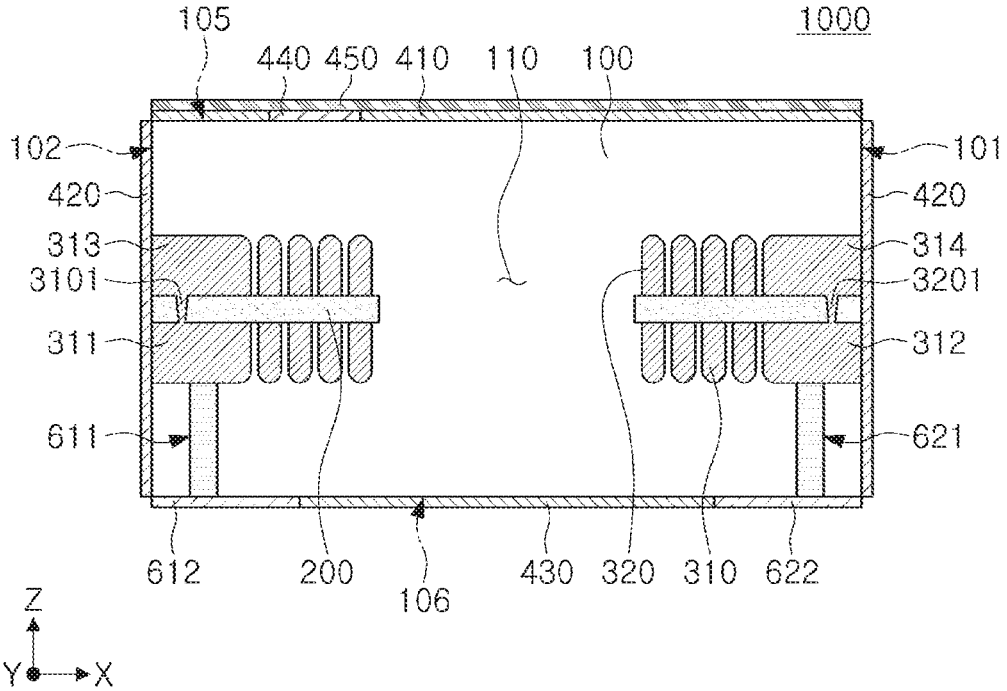
FIG. 4 is a view illustrating a coil component according to a second modified embodiment of the first embodiment of the present disclosure and corresponding to the cross-sectional view taken along line I-I' of FIG. 1.

FIG. 4 is a view illustrating a coil component according to a second modified embodiment of the first embodiment of the present disclosure and corresponding to the cross-sectional view taken along line I-I' of FIG. 1.

A coil component 1000 according to this modified embodiment includes a coating layer 450 disposed in a different form, as compared with the coil component 1000 according to the first embodiment. Therefore, the description of this modification will focus on only the disposition form of the coating layer 450, a difference from the first embodiment. Descriptions of the other configurations of this embodiment may be substituted with those of the first embodiment as it is.

Referring to FIG. 4, the coating layer 450 is formed on a first insulating layer 410 to cover an entire fifth surface 105 of the body 100. As a result, a second insulating layer 420 may be more selectively formed on first to fourth surfaces 101, 102, 103, and 104 of the body 100. In this modified embodiment, the coating layer 450 may serves to significantly increase selectivity such that the second insulating layer 420 is not formed on the fifth surface 105 of the body 100, and thus, an identification function of the marking portion 440 may be further improved.

Third Modified Embodiment of First Embodiment

Figure 5:
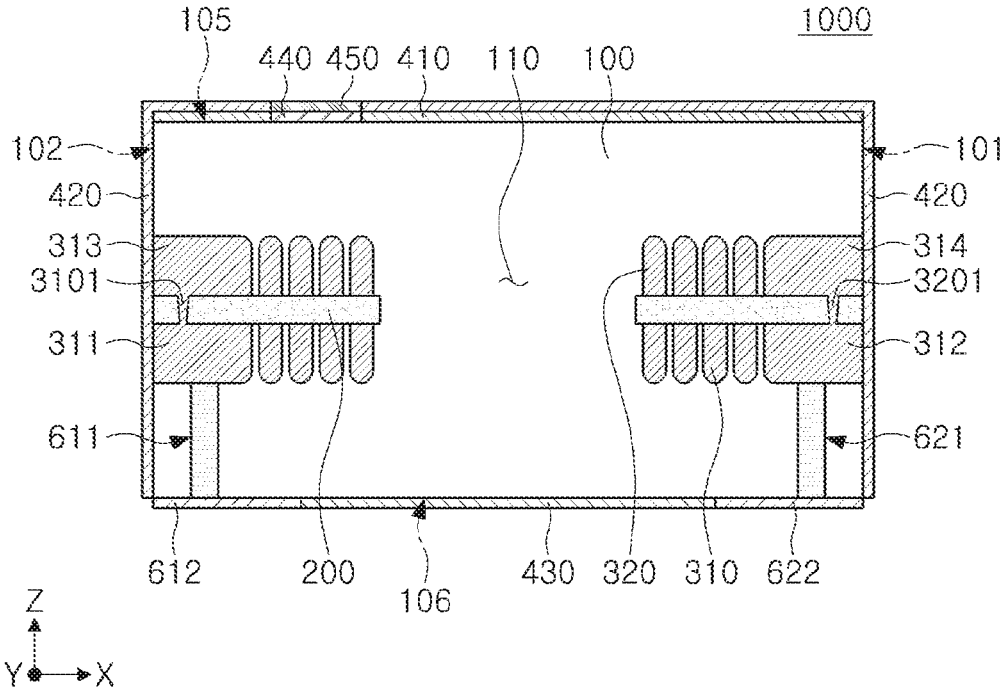
FIG. 5 is a view illustrating a coil component according to a third modified embodiment of the first embodiment of the present disclosure and corresponding to the cross-sectional view taken along line I-I' of FIG. 1.

FIG. 5 is a view illustrating a coil component according to a third modified embodiment of the first embodiment of the present disclosure and corresponding to the cross-sectional view taken along line I-I' of FIG. 1.

A coil component 1000 according to this modified embodiment includes a second insulating layer 420 disposed in a different form, as compared with the coil component 1000 according to the first embodiment. Therefore, the description of this modification will focus on only the disposition form of the second insulating layer 420, a difference from the first embodiment. Descriptions of the other configurations of this embodiment may be substituted with those of the first embodiment as it is.

The second insulating layer 420 is disposed to extend upwardly of a first insulating layer 410, but is not disposed to extend upwardly of a coating layer 450.

In the related art, when the second insulating layer 420 is formed on a plurality of side surfaces of a body 100 using a spray method or the like, the second insulating layer 420 may extend to an upper portion of the body 100 to cover a marking portion 440. In this modified embodiment, the second insulating layer 420 is not disposed to extend upwardly of the coating layer 450. Thus, the second insulating layer 420 may be selectively formed in a region of a fifth surface 105 of the body 100 in which the marking portion 440 is not formed. As illustrated in FIG. 5, when the second insulating layer 420 is disposed to extend upwardly of a first insulating layer 410, the coating layer 450 may be formed so as not to protrude from an entire component, and thus, a size of the entire component may be reduced.

Second Embodiment

Figure 6:
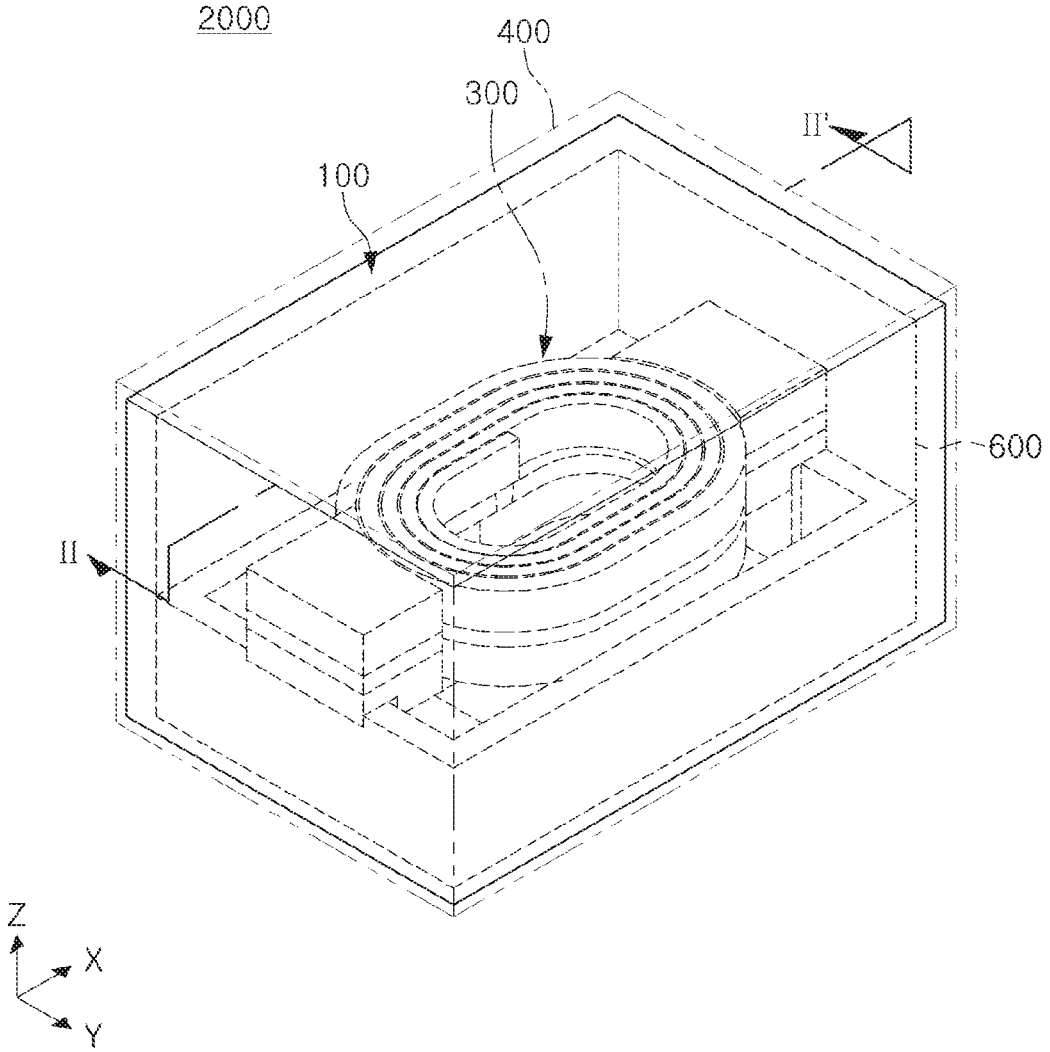
FIG. 6 is a schematic diagram of a coil component according to a second embodiment of the present disclosure.
Figure 7:
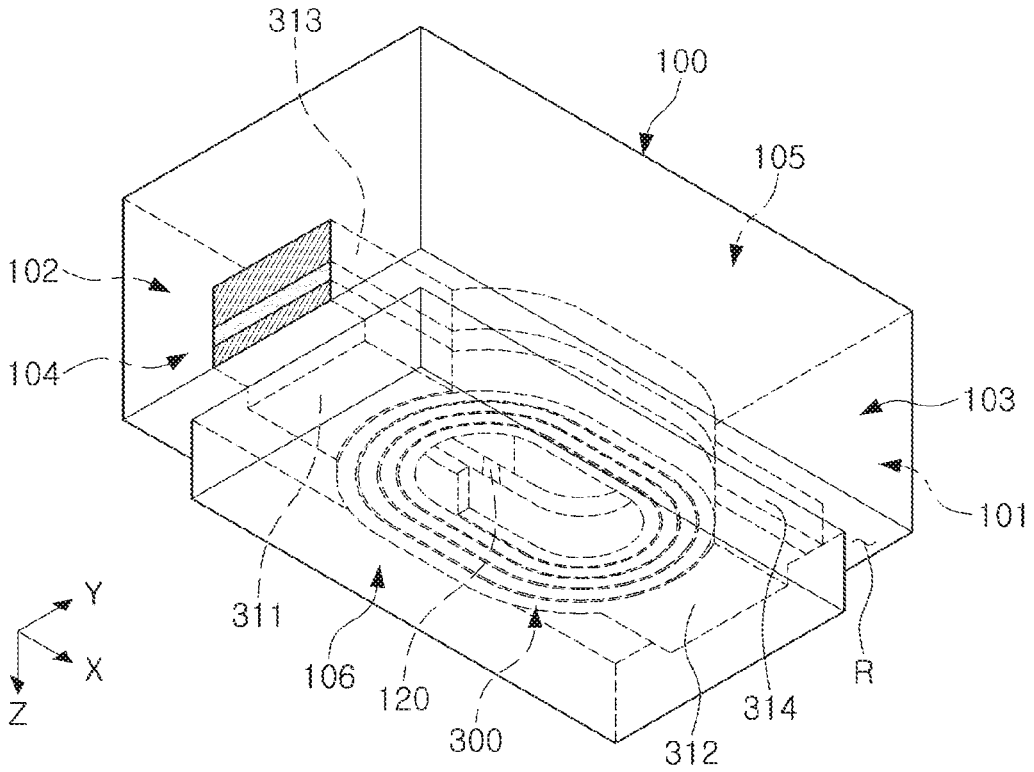
FIG. 7 is a view of a body of the coil component in FIG. 6, when viewed from below.

FIG. 6 is a schematic diagram of a coil component according to a second embodiment of the present disclosure, and FIG. 7 is a view of a body of the coil component in FIG. 6, when viewed from below.

A coil component 2000 according to this modified embodiment further includes a recess R and a filling portion 500 (shown in FIG. 8), as compared with the coil component 1000 according to the first embodiment. Therefore, the description of this modification will focus on only the recess R and the filling portion 500, a difference from the first embodiment. Descriptions of the other configurations of this embodiment may be substituted with those of the first embodiment as it is.

The recess R is formed to surround first to fourth surfaces 101, 102, 103, and 104 of a body 100 on a side of a sixth surface 106 of the body 100. For example, the recesses R is formed along an entire corner region formed by each of the first to fourth surfaces 101, 102, 103, and 104 of the body 100 and the sixth surface 106 of the body 100. The recess R does not extend to the fifth surface 105 of the body 100. For example, the recess R does not penetrate through the body 100 in a thickness direction Z of the body 100.

The recess R may be formed by performing pre-dicing on a boundary line (a dicing line or a singulation line) between each body 100 on a side of one surface of a coil bar. A width of a pre-dicing tip, used in the pre-dicing, is larger than a width of a dicing line of the coil bar. The term "coil bar" refers to a state in which a plurality of bodies 100 are connected to each other in length and width directions of the body 100. In addition, the term "width of dicing line" refers to a width of a full-dicing tip of full dicing for individualizing the coil bar.

A depth at the time of such pre-dicing is adjusted such that a portion of each of the first and second lead-out patterns 311 and 312 may be removed together with a portion of the body 100. For example, the depth is adjusted such that the first and second lead-out patterns 311 and 312 are exposed to an internal surface of the recess R. However, a depth at the time of free dicing is adjusted so as not to penetrate through one surface and the other surface of the coil bar. Accordingly, even after pre-dicing, the coil bar is maintained in a state in which a plurality of bodies are connected to each other.

An internal wall of the recess R, an internal surface of the recess R, and a lower surface of the recess R constitute a surface of the body 100. However, for ease of the description, the internal wall of the recess R and the lower surface of the recess R will be distinguished from the surface of the body 100.

Each of the first and second lead-out patterns 311 and 312 is exposed to an internal surface of the recess R. In a process of forming the recess R, a portion of each of the first and second lead-out patterns 311 and 312 is also removed together with a portion of the body 100. For example, the recess R extends to the respective first and second lead-out patterns 311 and 312. Accordingly, first and second external electrodes 610 and 620 to be described later may be formed on the first and second lead-out patterns 311 and 312, exposed to the internal surface of the recess R, to connect a coil portion 300 and the first and second external electrodes 610 and 620 to each other.

Figure 8:
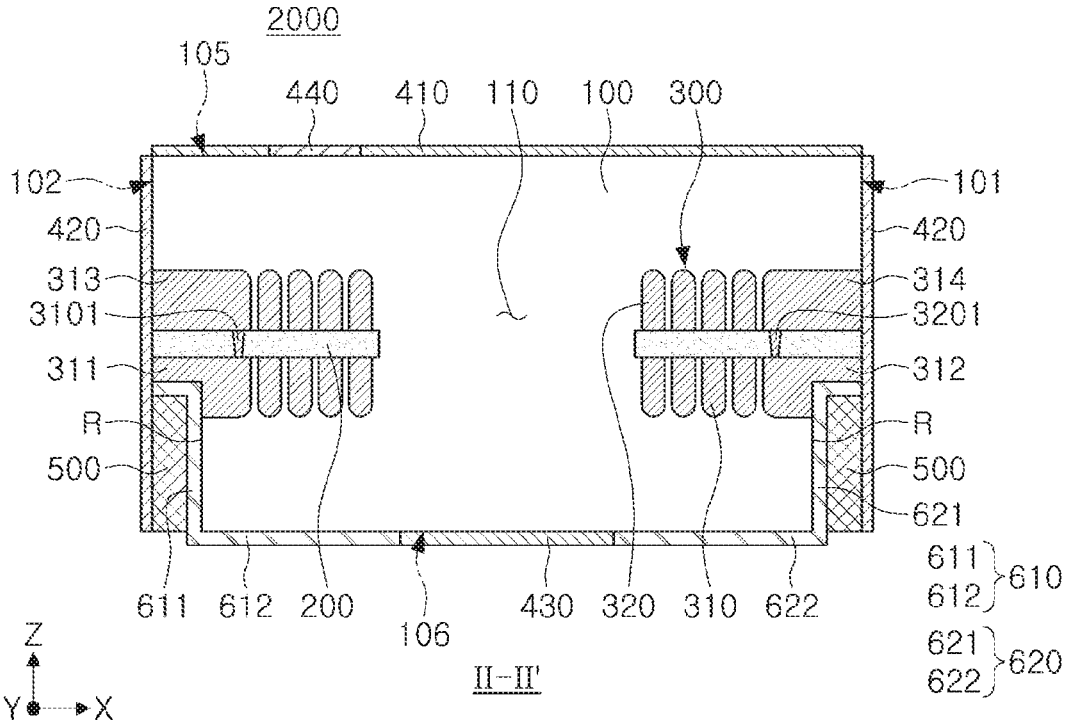
FIG. 8 is a cross-sectional view taken along line II-II' in FIG. 6.

In FIG. 8, the recess R is illustrated as penetrating through a lower portion of each of the first and second lead-out patterns 311 and 312, so that the first and second lead-out patterns 311 and 312 are exposed to an internal wall and a lower surface of the recess R. However, this is just an example. That is, as a non-limiting example, the depth at the time of pre-dicing may be adjusted to expose the first and second lead-out patterns 311 and 312 to the internal wall of the recess R, so that the recess R may be formed to penetrate through upper and lower portions of each of the first and second lead-out patterns 311 and 312. In addition, the recess R may be formed to have a depth at which the first lead-out pattern 311 is penetrated but the second lead-out pattern 312 is not penetrated. In this case, the first lead-out pattern 311 may be exposed to the internal wall of the recess R, and the second lead-out pattern 312 may be exposed to both the lower surface and the internal wall of the recess R. In addition, as another non-limiting example, the depth of the recess R formed on aside of the first surface 101 of the body 100 and the depth of the recess R formed on a side of the second surface 102 of the body 100 may be different from each other.

One surface of each of the first and second lead-out patterns 311 and 312, exposed to the internal surface of the recess R, may have higher surface roughness than the other surfaces of each of the first and second lead-out patterns 311 and 312. For example, when the first and second lead-out patterns 311 and 312 are formed by plating and the recess R is formed by the above-described pre-dicing, a portion of the first and second lead-out patterns 311 and 312 may be removed by a free dicing tip. Accordingly, one surface of each of the first and second lead-out patterns 311 and 312, exposed to the internal surface of the recess R, may be formed to have higher surface roughness than the other surfaces of the first and second lead-out patterns 311 and 312 due to polishing using a pre-dicing tip. As will be describe later, each of the first and second external electrodes 610 and 620 may be formed as a thin film, so that bonding force to the body 100 is poor. Since the first and second external electrodes 610 and 620 is in contact with and connected to one surface of each of the first and second lead-out patterns 311 and 312 having relatively high surface roughness, bonding force between the first and second external electrodes 610 and 620 and the first and second lead-out patterns 311 and 312 may be improved.

The first and second external electrodes 610 and 620 may include first and second connection portions 611 and 621, disposed in the recess R to be connected to the first and second lead-out patterns 311 and 312, and first and second extension portions 611 and 621 extending to the first and second connection portions 611 and 621 and disposed on the sixth surface 106 of the body 100, respectively. The first and second external electrodes 610 and 620 may be spaced apart from each other. The first external electrode 610 and the second external electrode 620 may be electrically connected by the coil portion 300, but may be disposed on the surfaces of the body 100 and the recess R to be spaced apart from each other.

Specifically, the first external electrode 610 may include the first connection portion 611 disposed in a region, in which the first lead-out pattern 311 is exposed, of the internal surface of the recess R to be in contact with and connected to the first lead-out pattern 311 and the first extension portion 611 extending from the first connection portion 611 to the sixth surface 106 of the body 100. The second external electrode 620 may include the second connection portion 621 disposed in a region, in which the second lead-out pattern 312 is exposed, of the internal surface of the recess R to be in contact with and connected to the second lead-out pattern 312 and the second extension portion 622 extending from the second connection portion 621 to the sixth surface 106 of the body 100. Each of the first and second external electrodes 610 and 620 may be formed along the internal surface of the recess R and the sixth surface 106 of the body 100. For example, each of the first and second external electrodes 610 and 620 may be provided in the form of a conformal film.

Each of the first and second external electrodes 610 and 620 may be integrally formed on the sixth surface 106 of the body 100. For example, the first connection portion 611 and the first extension portion 612 of the first external electrode 610 may be formed together in the same process to be integrated with each other, and the second connection portion 621 and the second extension 622 of the second external electrode 620 may be formed together in the same process to be integrated with each other. The first and second external electrodes 610 and 620 may be formed by a thin film process such as a sputtering process.

The filling portion 500 fills the recess R and covers the connecting portions 611 and 621. For example, in the case of the present disclosure, the connection portions 611 and 621 of the first and second external electrodes 610 and 620 may be disposed between the filling portion 500 and the internal surface of the recess R.

One surface of the filling portion 500 may be disposed on substantially the same plane as each of the first and second surfaces 101 and 102 of the body 100 and the third and fourth surfaces 103 and 104 of the body 100. For example, by performing full-dicing after forming the first and second external electrodes 610 and 620 in a coil bar state and filling a space between the connection portions 611 and 621 of an adjacent body 100 with a material for forming a filling portion, one surface of the filling portion 500 may be disposed on substantially the same plane as each of the first to fourth surfaces 101, 102, 103, and 104 of the body 100.

The filling portion 500 may include an insulating resin. The insulating resin may include an epoxy, a polyimide, a liquid crystal polymer, or the like, in a single form or in combined forms, but the present disclosure is not limited thereto.

The filling portion 500 may further include magnetic powder particles dispersed in an insulating resin. The magnetic powder particle may be, for example, a ferrite powder particle or a magnetic metal powder particle.

Examples of the ferrite powder particle may include at least one of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The magnetic metal powder particle may include at least one selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic powder particle may be amorphous or crystalline. For example, the magnetic metal powder particle may be a Fe—Si—B—Cr-based amorphous alloy powder particle, but the present disclosure is not limited thereto.

Each of the ferrite powder particle and the magnetic metal powder particle may have an average of about 0.1 μm to about 30 μm, but the present disclosure is not limited thereto

First Modified Embodiment of Second Embodiment

Figure 9:
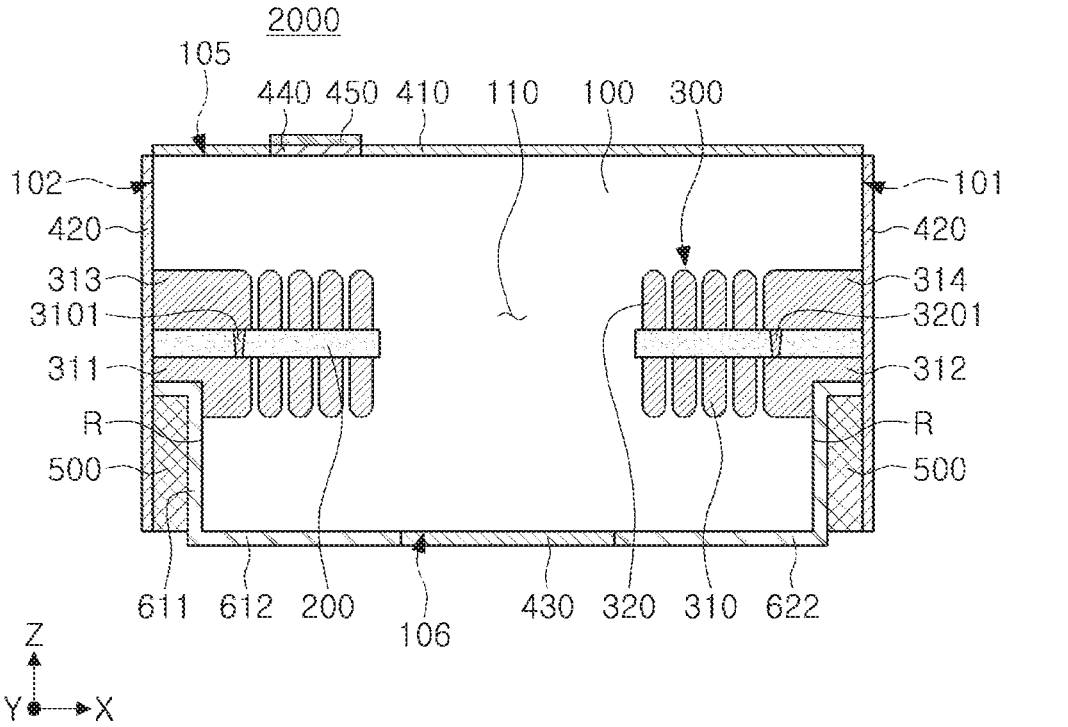
FIG. 9 is a view illustrating a coil component according to a first modified embodiment of the second embodiment of the present disclosure and corresponding to the cross-sectional view taken along line II-II' of FIG. 6.

FIG. 9 is a view illustrating a coil component according to a first modified embodiment of the second embodiment of the present disclosure and corresponding to the cross-sectional view taken along line II-II' of FIG. 6.

A coil component 2000 according to this modified embodiment further includes a coating layer 450, as compared with the coil component 2000 according to the second embodiment. Therefore, the description of this modification will focus on only coating layer 450, a difference from the second embodiment. Descriptions of the other configurations of this embodiment may be substituted with those of the first embodiment as it is.

Referring to FIG. 9, the coating layer 450 is disposed on a marking portion 440.

When a second insulating layer 420 is formed on a plurality of side surfaces of a body 100 according to the related art, the second insulating layer 420 may extend to an upper portion of the body 100 to cover a marking portion 440. In this embodiment, the coating layer 450 may be additionally disposed on the marking portion 440 to selectively form a second insulating layer 420 on a portion of a fifth surface 105 of the body 100, in which the marking portion 440 is not formed, and first to fourth surface 101, 102, 103, and 104 of the body 100. As illustrated in FIG. 9, when the coating layer 450 is formed to correspond to a region in which the marking part 440 is formed, an area occupied by the coating layer 450 in the component may be significantly reduced, and thus, a size of the entire component may be reduced.

Second Modified Embodiment of Second Embodiment

Figure 10:
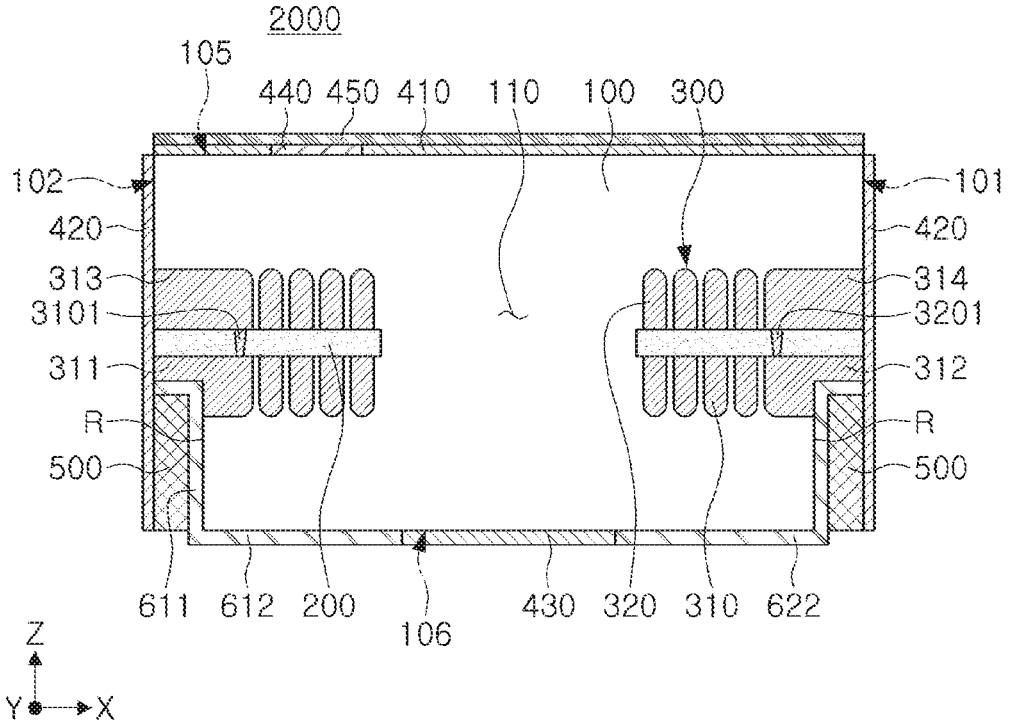
FIG. 10 is a view illustrating a coil component according to a second modified embodiment of the second embodiment of the present disclosure and corresponding to the cross-sectional view taken along line II-II' of FIG. 6.

FIG. 10 is a view illustrating a coil component according to a second modified embodiment of the second embodiment of the present disclosure and corresponding to the cross-sectional view taken along line II-II' of FIG. 6.

A coil component 2000 according to this modified embodiment includes a coating layer 450 disposed in a different form, as compared with the coil component 2000 according to the second embodiment. Therefore, the description of this modification will focus on only the disposition form of the coating layer 450, a difference from the second embodiment. Descriptions of the other configurations of this embodiment may be substituted with those of the first embodiment as it is.

The collating layer 450 is disposed to expose upwardly of the first insulating layer 410.

Referring to FIG. 10, the coating layer 450 is formed on a first insulating layer 410 to cover an entire fifth surface 105 of the body 100. As a result, a second insulating layer 420 may be more selectively formed on first to fourth surfaces 101, 102, 103, and 104 of the body 100. In this modified embodiment, the coating layer 450 may serves to significantly increase selectivity such that the second insulating layer 420 is not formed on the fifth surface 105 of the body 100, and thus, an identification function of the marking portion 440 may be further improved.

Third Modified Embodiment of Second Embodiment

Figure 11:
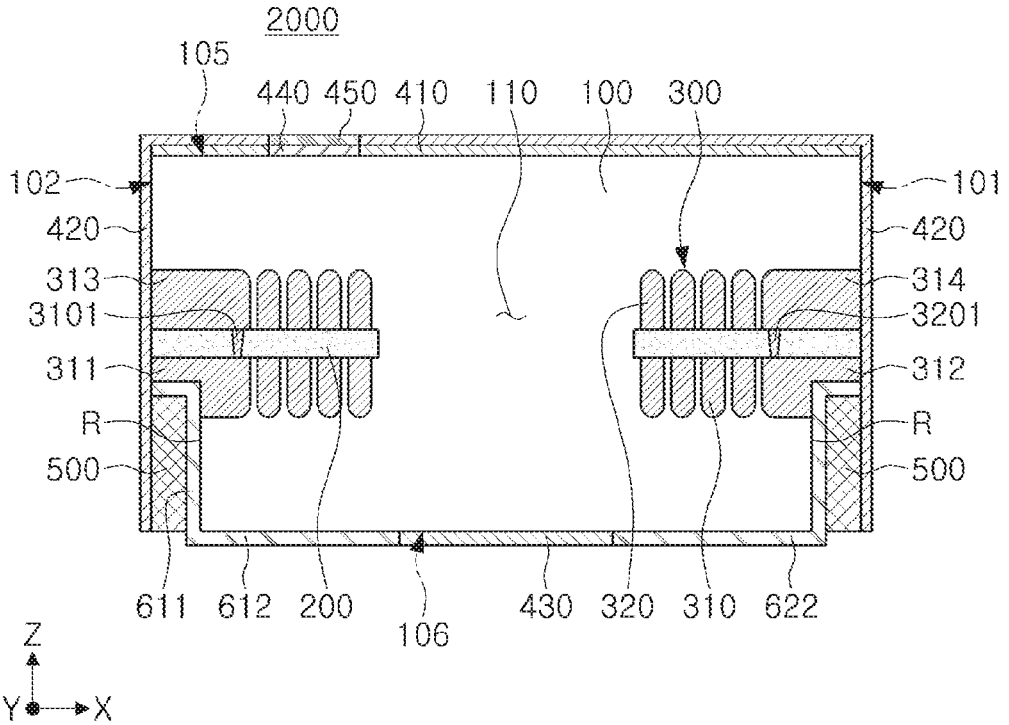
FIG. 11 is a view illustrating a coil component according to a third modified embodiment of the second embodiment of the present disclosure and corresponding to the cross-sectional view taken along line II-II' of FIG. 6.

FIG. 11 is a view illustrating a coil component according to a third modified embodiment of the second embodiment of the present disclosure and corresponding to the cross-sectional view taken along line II-II' of FIG. 6.

A coil component 2000 according to this modified embodiment includes a second insulating layer 420 disposed in a different form, as compared with the coil component 2000 according to the second embodiment. Therefore, the description of this modification will focus on only the disposition form of the second insulating layer 420, a difference from the second embodiment. Descriptions of the other configurations of this embodiment may be substituted with those of the first embodiment as it is.

The second insulating layer 420 is disposed to extend upwardly of a first insulating layer 410, but is not disposed to extend upwardly of a coating layer 450.

In the related art, when the second insulating layer 420 is formed on a plurality of side surfaces of a body 100 using a spray method or the like, the second insulating layer 420 may extend to an upper portion of the body 100 to cover a marking portion 440. In this modified embodiment, the second insulating layer 420 is not disposed to extend upwardly of the coating layer 450. Thus, the second insulating layer 420 may be selectively formed in a region of a fifth surface 105 of the body 100 in which the marking portion 440 is not formed. As illustrated in FIG. 11, when the second insulating layer 420 is disposed to extend upwardly of a first insulating layer 410, the coating layer 450 may be formed so as not to protrude from an entire component, and thus, a size of the entire component may be reduced.

As described above, the present disclosure relates to a coil component including a support substrate, a coil portion disposed on at least one surface of the support substrate, a body, in which the support substrate and the coil portion are disposed, having one surface and the other surface opposing each other, a first external electrode and a second external electrode disposed on the other surface of the body to be spaced apart from each other and connected to the coil portion, a marking portion disposed on the one surface of the body, and a first insulating layer disposed on the one surface of the body and provided with an opening formed to expose the marking portion. The marking portion has a thickness less than or equal to a thickness of the marking portion.

While example embodiments have been shown and described above, it will be apparent to those skilled in the art that modifications and variations could be made without departing from the scope of the present disclosure as defined by the appended claims.

What is claimed is:

1. A coil component comprising:

a coil portion;

a body, in which the coil portion is disposed, having one surface and the other surface opposing each other;

a first external electrode and a second external electrode disposed on the other surface of the body to be spaced apart from each other and connected to the coil portion;

a marking portion disposed on the one surface of the body;

a first insulating layer disposed on the one surface of the body and having an opening in which the marking portion is disposed; and a coating layer disposed on the marking portion to correspond to an area of the marking portion, wherein the body further comprises a plurality of side surfaces, each connecting one surface and the other surface of the body to each other, the coil component further comprises a second insulating layer disposed on the plurality of side surfaces of the body, and the second insulating layer extends on the first insulating layer and has another opening in which the coating layer is disposed.

2. The coil component of claim 1, wherein the marking portion and the first insulating layer have different colors.

3. The coil component of claim 1, wherein the marking portion has the thickness corresponding to the thickness of the first insulating layer.

4. The coil component of claim 1, wherein the marking portion and the coating layer have different colors.

5. The coil component of claim 1, further comprising:

a third insulating layer disposed in a region of the other surface of the body, other than a region in which the first and second external electrodes are disposed.

6. The coil component of claim 1, wherein the coil portion comprises a first lead-out pattern, disposed on the one surface of the support substrate, and a second lead-out pattern disposed to be spaced apart from the first lead-out pattern, and the first and second external electrodes are connected to the first and second lead-out patterns, respectively.

7. The coil component of claim 6, wherein the first external electrode includes a first connection portion, connected to the first lead-out pattern, and a first extension portion extending to the first connection portion and disposed on the other surface of the body, and the second external electrode includes a second connection portion, connected to the second lead-out pattern, and a second extension portion extending to the second connection portion and disposed on the other surface of the body.

8. The coil component of claim 7, further comprising:

a recess disposed on each corner of the other surface of the body and exposing the first and second lead-out patterns, wherein the connection portion is disposed on the recess.

9. The coil component of claim 1, wherein the marking portion includes an insulating material.

10. The coil component of claim 1, wherein the marking portion is in contact with a magnetic material of the body.

11. The coil component of claim 1, wherein the thickness of the marking portion is 10 μm or less.

12. The coil component of claim 1, further comprising a support substrate disposed in the body, wherein the coil portion is disposed on the support substrate.

13. The coil component of claim 1, wherein the marking portion has a thickness less than or equal to a thickness of the first insulating layer.

14. A coil component comprising:

a coil portion;

a body, in which the coil portion is disposed, having one surface and the other surface opposing each other;

a first external electrode and a second external electrode disposed on the other surface of the body to be spaced apart from each other and connected to the coil portion;

a marking portion disposed on the one surface of the body;

a first insulating layer disposed on the one surface of the body and having an opening in which the marking portion is disposed; and a coating layer disposed on the marking portion, wherein the first insulating layer includes one surface facing the body and another surface opposing the one surface of the insulating layer, a portion of the another surface of the first insulating layer is spaced apart from the coating layer, and among the first insulating layer and the marking portion, the coating layer overlaps only the marking portion.

15. The coil component of claim 14, wherein the marking portion has a thickness less than or equal to a thickness of the first insulating layer.

16. The coil component of claim 14, further comprising a second insulating layer disposed on the first insulating layer and having another opening in which the coating layer is disposed.

17. The coil component of claim 14, further comprising a support substrate disposed in the body, wherein the coil portion is disposed on the support substrate.

* * * * *